US010598389B2

(12) United States Patent
Cowan et al.

(10) Patent No.: US 10,598,389 B2
(45) Date of Patent: Mar. 24, 2020

(54) HINGED GRATES FOR COOKING APPLIANCE

(71) Applicant: Midea Group Co., Ltd., Beijiao, Shunde, Foshan (CN)

(72) Inventors: Richard W. Cowan, Louisville, KY (US); Daniel J. Trice, Louisville, KY (US)

(73) Assignee: MIDEA GROUP CO., LTD., Beijiao, Shunde, Foshan (CN)

( * ) Notice: Subject to any disclaimer, the term of this patent is extended or adjusted under 35 U.S.C. 154(b) by 71 days.

(21) Appl. No.: 16/008,733

(22) Filed: Jun. 14, 2018

(65) Prior Publication Data

US 2019/0383497 A1 Dec. 19, 2019

(51) Int. Cl.
*F24C 15/10* (2006.01)
*F24C 3/02* (2006.01)

(52) U.S. Cl.
CPC ..... *F24C 15/107* (2013.01); *F24C 3/027* (2013.01)

(58) Field of Classification Search
CPC ..... F24C 15/107
See application file for complete search history.

(56) References Cited

U.S. PATENT DOCUMENTS

| | | | | |
|---|---|---|---|---|
| 3,586,826 | A | 6/1971 | Dills | |
| 3,645,249 | A | 2/1972 | Henderson et al. | |
| 4,869,231 | A | 9/1989 | Rice et al. | |
| 5,215,074 | A | 6/1993 | Wilson et al. | |
| 5,490,494 | A | 2/1996 | Giebel et al. | |
| 5,813,396 | A | 9/1998 | Bessette | |
| 6,065,394 | A | 5/2000 | Gelderman | |
| 6,399,924 | B1 | 6/2002 | Cai | |
| 8,297,272 | B2 | 10/2012 | Williams et al. | |
| 8,910,622 | B2 * | 12/2014 | Mishra | F24C 15/107 126/212 |
| 9,903,593 | B2 * | 2/2018 | Breneman | F24C 15/107 |
| 2005/0095547 | A1 | 5/2005 | Pottenger et al. | |
| 2011/0114077 | A1 | 5/2011 | Mishra et al. | |
| 2014/0158676 | A1 | 6/2014 | Phillips et al. | |
| 2014/0305422 | A1 | 10/2014 | Breneman et al. | |
| 2017/0227235 | A1 | 8/2017 | Best et al. | |
| 2019/0184506 | A1 * | 6/2019 | Conde Zelocuatecatl | B23P 19/04 |

FOREIGN PATENT DOCUMENTS

| | | |
|---|---|---|
| CN | 2368248 Y | 3/2000 |
| CN | 202761087 U | 3/2013 |
| CN | 202761088 U | 3/2013 |

(Continued)

OTHER PUBLICATIONS

"36 in. Gas Cooktop in Stainless Steel with 5 Burners including EZ-2-Lift Hinged Grates" Whirlpool. www.homedepot.com. Retrieved Jan. 8 , 2018.

(Continued)

*Primary Examiner* — David J Laux
(74) *Attorney, Agent, or Firm* — Middleton Reutlinger

(57) ABSTRACT

A cooking grate that is hinged directly to the structural framework of an appliance is disclosed. The cooking grate may include one or more grate hinge brackets that are connected behind or through a cooktop without connection to the cooktop. One or more cooking grates may be used in a variety of applications.

20 Claims, 17 Drawing Sheets

(56) References Cited

FOREIGN PATENT DOCUMENTS

| | | | |
|---|---|---|---|
| CN | 206933977 | U | 1/2018 |
| CN | 206933980 | U | 1/2018 |
| EP | 2792954 | B1 | 3/2017 |
| GB | 169770 | A | 9/1921 |
| WO | WO1999035443 | A1 | 7/1999 |
| WO | WO2013011169 | A1 | 1/2013 |
| WO | WO2017189400 | A1 | 11/2017 |

OTHER PUBLICATIONS

"Napoleon 75022 Cast Grid for NK22CK-C & PRO22K-LEG" Napoleon. www.spotix.com. Retrieved Jan. 8, 2018.
International Search Report and Written Opinion of PCT Ser. No. PCT/CN2018/123992, dated Mar. 27, 2019.

* cited by examiner

HINGED GRATES FOR COOKING APPLIANCE

BACKGROUND

The present embodiments relate to a grate for a cooking appliance that is hinged to the structure of the cooking appliance and particularly, but not limited to, a hinged cooking grate for a gas range.

Various cooking grates have been proposed in the art for cooking appliances. Often, in the case of a gas range, the cooking appliance includes a cooktop surface. The cooktop surface typically includes one or more cooking areas disposed about the cooktop surface, and in the case of a gas range, each cooking area typically includes at least one gas burner extending through at least one gas burner opening in the cooktop surface. The cooking areas generally have associated with the gas burners one or more grates disposed above the gas burner and which provide a generally planar and generally horizontal surface for providing support for cooking vessels (such as pots and pans). Each grate generally has one or more feet that rests on the cooktop surface and space the grate a desired distance above the cooktop surface and gas burner. Typically each grate is freestanding, that is, not connected to the cooktop surface.

Often, during use, the cooktop surface gets dirty with spills from the cooking vessels. These spills sometimes soil not only the cooktop surface, but also the grates. The individual freestanding grates can be removed from the appliance for cleaning (as in a sink or a dishwasher), and the cooktop surface can be more easily cleaned with the grates having been removed.

Several disadvantages are associated with such an arrangement. First, the grates tend to be heavy and/or awkward to move, so removing them in order to clean the cooktop surface can be cumbersome. Also, removing the grates requires having a place to set the grates temporarily while the cooktop is being cleaned, and space is often not available. Even if the space is available for temporarily placing the grates, because the grates are usually heavy metal items, they can scratch or damage the surfaces (such as adjacent countertops) on which they are placed. Additionally, replacing the grates back on the cooktops can cause damage to the cooktops if the grates are mishandled or misaligned in any way.

Some attempts to resolve these problems have included providing grates that are hinged to the cooktop itself. However, several problems exist with regard to hinging grates to the cooktop. First, connecting the grates to the cooktop requires that the cooktop be made strong enough to handle the multiple heavy metal grates. Structurally this requires that the cooktop be thick and rigid, and have edges that are strengthened to accommodate the hinges. This in turn dramatically increases the cost and manufacturing complexity to fabricate the cooktop. Second, because typical cooktops span the entirety of the upper surface of the range, typical hinged grates span nearly the entirety of the upper cooking surface, thus adding to their size and therefore their weight. It is not uncommon for each grate to weight 10-15 pounds. Third, if grates that are hinged to the cooktop happen to fall harshly onto the cooktop causing damage to the cooktop surface, the only repair solution is to replace the cooktop, which is costly, time-consuming, and labor-intensive.

Thus, there is a need to provide grates for a gas cooking range that are hinged to the structure of the range and not connected to the cooktop itself. This would enable the cooktops to be fabricated less expensively. Enabling grates and cooktops to be separate items not connected to each other provides additional options for grate sizing and design that are not possible with grates that are hinged to the cooktop.

SUMMARY

In some embodiments, a cooking appliance includes a housing having a cooktop surface, at least one gas burner positioned in the cooktop surface, and at least one cooking grate having a cooking surface. The grate is hingedly connected to the structural members of the cooking appliance.

In some embodiments a cooking appliance is provided having a structural framework; a cooktop supported by the structural framework and having a first burner opening therethrough. The cooktop has a cooktop perimeter having a cooktop rear edge, a cooktop left edge, a cooktop right edge, and a cooktop front edge. A first gas burner extends through the first burner opening in the cooktop, and the first gas burner is connected to a gas source. A cooking grate forming a cooking surface for supporting a cooking vessel is disposed above said first gas burner for cooking food. A grate hinge bracket is mounted directly to the structural framework for hinged connection to the cooking grate to allow the cooking grate to pivot through a range of positions from a first position to a second position, wherein in the first position the cooking grate is disposed horizontally over the first gas burner, and in the second position the cooking grate is disposed at an angle with respect to the cooktop.

In some embodiments, a cooking appliance comprises a structural framework; a cooktop supported by the structural framework and having a cooktop bottom and a cooktop perimeter, which further comprises a cooktop front, a cooktop rear, a cooktop left side, and a cooktop right side. A grate hinge bracket is positioned at a first location external to the cooktop perimeter and adjacent to one of the cooktop front, cooktop rear, cooktop left side, or cooktop right side, wherein the grate hinge bracket is directly coupled to said structural framework at the first location, wherein said first location does not go through said cooktop bottom.

In some embodiments, a cooking appliance has a structural framework and a cooktop supported by the structural framework, and the cooktop has a first burner opening therethrough and a cooktop perimeter defining an outermost periphery of the cooktop. In such an appliance, there is provided at least one hinge bracket opening in the cooktop disposed internal to the cooktop perimeter. A cooking grate forming a cooking surface for supporting a cooking vessel is disposed above the first burner opening. A grate hinge bracket is mounted directly to the structural framework for hinged connection to the cooking grate through the at least one hinge bracket opening in the cooktop to allow the cooking grate to pivot through a range of positions from a first position to a second position. In the first position the cooking grate is disposed horizontally over the first gas burner, and in the second position the cooking grate is disposed at an angle with respect to the cooktop.

These and other advantages and features, which characterize the embodiments, are set forth in the claims annexed hereto and forming a further part hereof. However, for a better understanding of the embodiments, and of the advantages and objectives attained through its use, reference should be made to the Drawings, and to the accompanying descriptive matter, in which there is described example embodiments. This summary is merely provided to introduce a selection of concepts that are further described below in the detailed description, and is not intended to identify key or essential features of the claimed subject matter, nor is it intended to be used in any way to limit the scope of the claimed subject matter.

BRIEF DESCRIPTION OF THE DRAWINGS

In the drawings, like reference characters generally refer to the same or similar parts throughout the different views. Also, the drawings are not necessarily to scale, emphasis instead generally being placed upon illustrating the principles of the invention.

DETAILED DESCRIPTION

Figure 1:
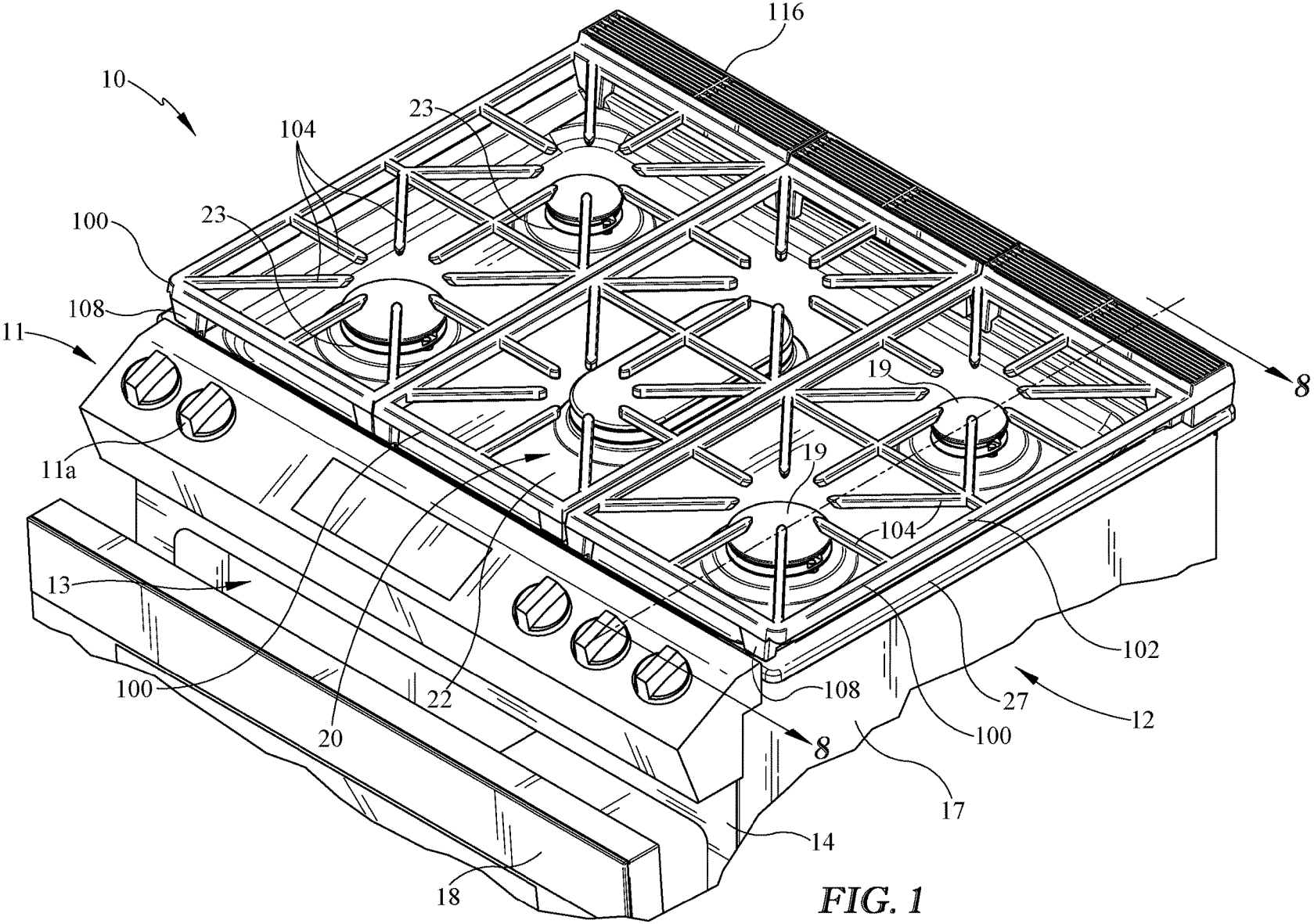
FIG. 1 is a top right front perspective view of one embodiment of the cooking grates residing atop a cooking appliance.
Figure 2:
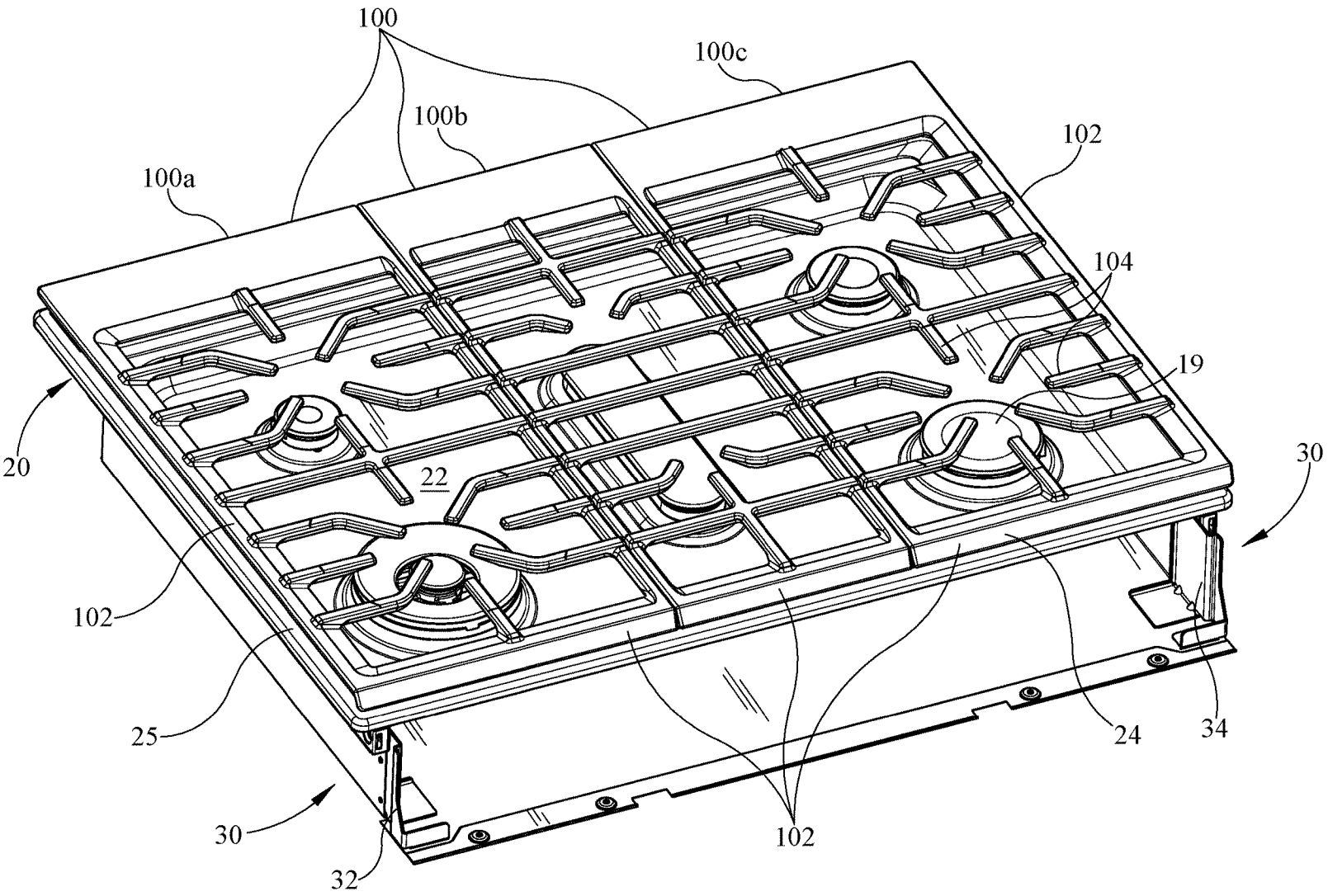
FIG. 2 is top left front perspective view of one embodiment of the cooking grates shown with portions of the cooking appliance having been removed to reveal portions of the structural framework of a cooking appliance.
Figure 3:
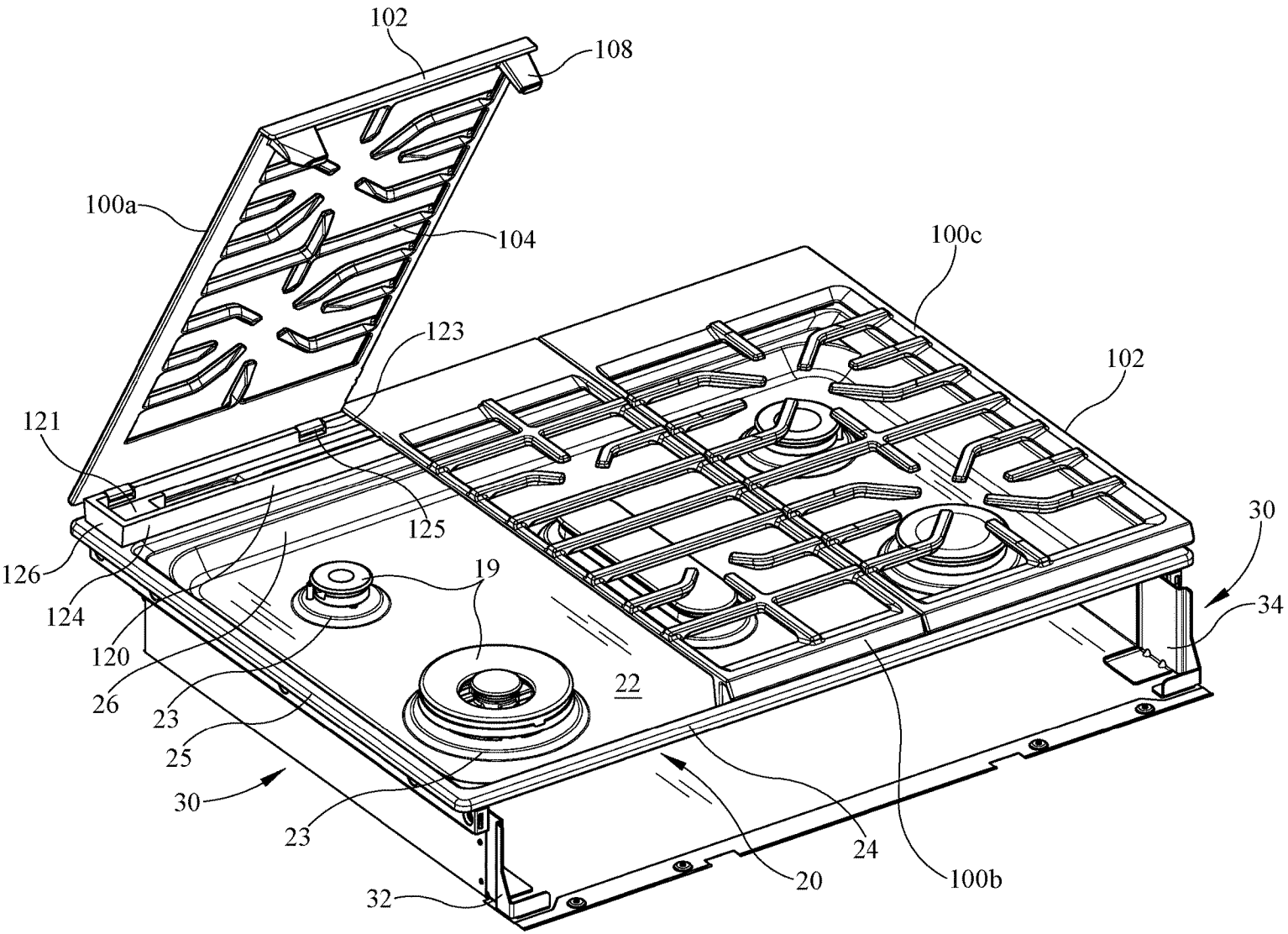
FIG. 3 is a top left front perspective view of one embodiment similar to that of FIG. 2, but showing one of multiple cooking grates residing in a second position, while two of multiple cooking grates are shown in a first position.

As shown in the Figures, a home cooking appliance 10, such as but not limited to a slide-in cooking range, has a housing 12 and an enclosed cooking compartment 13 (such as a baking oven, convection oven, steam oven, warming drawer and the like) in the housing 12. A control panel 11 with, for example, one or more inputs 11*a* (for example, knobs, dials, buttons, and the like) is typically provided to enable a user to control various functions of the appliance 10. The housing 12 generally comprises a housing front 14, housing rear 16, housing left side 15 and housing right side 17. An access panel 18 (such as a door or drawer) is typically coupled to the housing front 14. In the embodiment shown, the appliance 10 is a gas slide-in range. The teachings herein are equally applicable to freestanding ranges, counter top ranges, and the like.

The appliance 10 includes a cooktop 20 on a top of the housing 12. The cooktop 20 includes cooktop bottom 22 and cooktop perimeter 21 made up of cooktop front 24, cooktop rear 26, cooktop left side 25, and cooktop right side 27. The cooktop bottom 22 comprises one or more burner openings 23 therein to receive one or more burners 19 therethrough. As is typical, the one or more burners 19 receive a combustible gas from a gas source and regulate the emission of the gas through the one or more burners 19 to provide thermal energy to heat items situated thereabove.

The appliance further includes one or more cooking grates 100 thereon. FIGS. 1-7 show an embodiment with three grates (left grate 100*a*, middle grate 100*b*, and right grate 100*c*), collectively referred to as grates 100, but obviously any number of grates 100 are possible, with one to five being most typical. Alternatively, each burner 19 could have associated therewith its own grate 100 that is hinged to the structural framework 30. Each grate 100 has an outer frame 102 and a plurality of tines 104 projecting inwardly from the outer frame 102. The number, size, arrangement, and orientation of the tines 104 can all vary greatly, it being understood that their purpose, and that of the outer frame 102, is to provide the surface onto which cooking containers (pots, pans, and the like) are placed for cooking. One portion of the outer frame 102 comprises one or more first grate hinge receiving portions 106 for pivotally connecting the grate 100 to a grate hinge bracket 120 (described below) via a hinge 125 for enabling the grates 100 to swing along an arc of motion, along a hinge axis 107, from a first position 150 through a number of intermediate positions to a second position 160 (described below). The grates 100 further include one or more feet 108 depending downwardly therefrom. The feet 108 rest on top of the cooktop bottom 22 when the grates 100 are in the first position 150, or on other desired structures associated with the cooktop 20, and are dimensioned so that the grates 100 are disposed a predetermined distance above the cooktop bottom 22 (and therefore above the burners 19). As is shown in one embodiment, the one or more feet 108 engage one or more surfaces of the cooking apparatus 10 or housing 12 to space the cooking grates 100, or portions thereof, from the cooktop bottom 22 or other portions of the housing 12. One or more of the feet 108 may depend from the outer frame 102 of the cooking grate 100 and engage the cooktop bottom 22, although the feet 108 may extend from a variety of structures of the cooking grate 100. For instance, the feet may extend from one or more tines 104. As is shown, one pair of feet 108 may be adjacent the control panel 11, or front of the housing 12, while there might be no feet 108 located at the back of the grates 100 due to the fact that a grate hinge bracket 120 (described below) provides adequate vertical clearance of the grates 100 above the cooktop bottom 22 without additional feet 108. Other embodiments having no grate hinge bracket 120 may employ rear feet 108 that may be spaced from the outer periphery or back of the cooking grate 100.

The cooking grates 100 may be of a various known constructions, and typically may be formed from cast iron by a sand casting process that is commonly known in the art of manufacturing stove-top cooking grates.

Figures 10A, 10B:
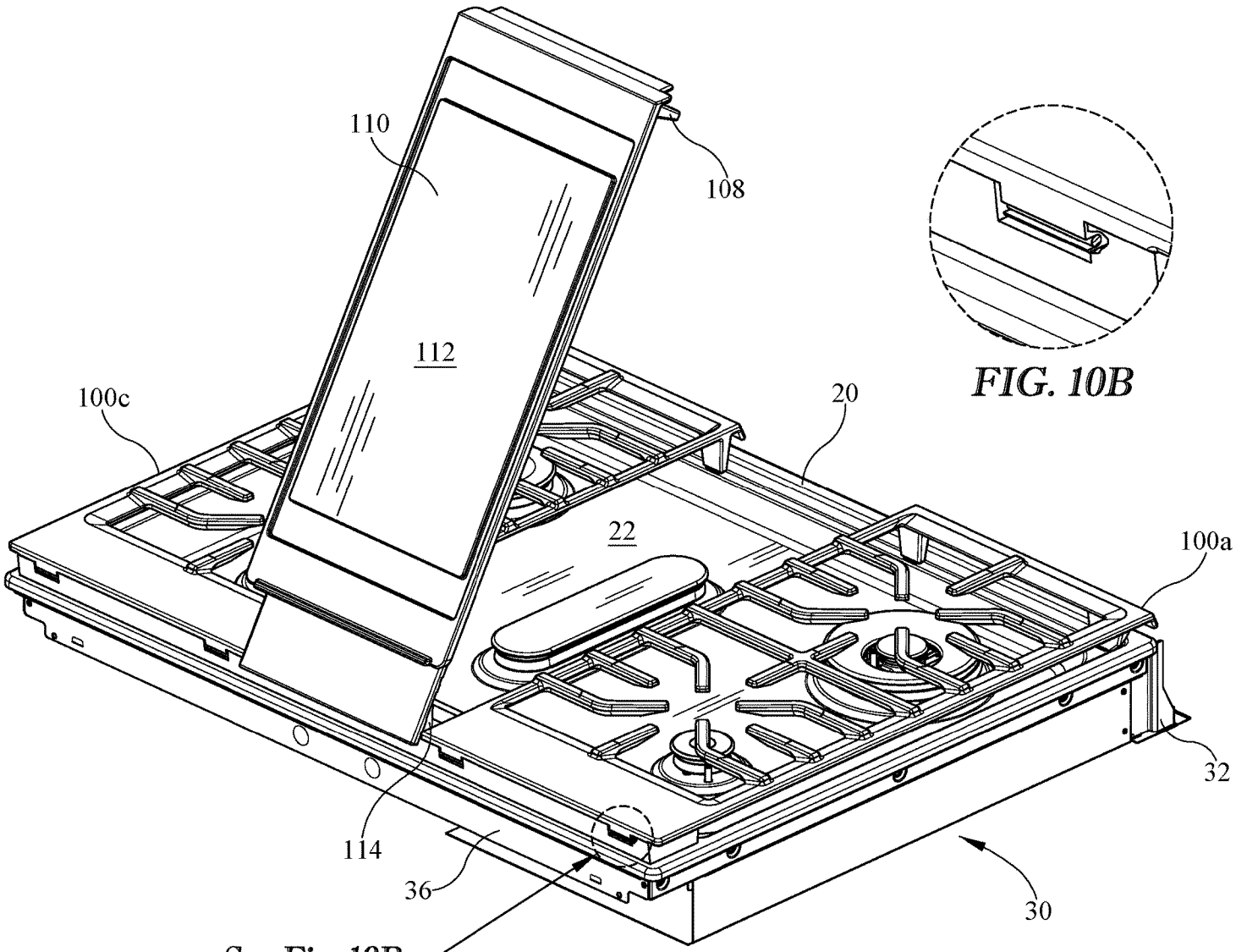
FIG. 10A is a top left rear perspective view of one embodiment.
FIG. 10B is a detail of a hinge connection of one embodiment.

In some embodiments (for example, the embodiment shown in FIG. 10A), one or more of the grates 100 could be replaced with a griddle 110 having a planar surface 112 without tines 104. In such embodiments, the griddle 110 includes one or more griddle hinge portions 114 located along a perimeter thereof, which serve a similar purpose as the first grate hinge receiving portion 106.

The cooking apparatus 10, as discussed above, includes a housing 12. The housing 12 provides the exterior shell of the apparatus 10, and is typically made of materials and in sizes that are commonly acceptable for kitchen appliances. For example, typical housings 12 for a slide-in range are made of sheet metal having various smooth and appealing finishes (stainless steel, aluminum, enamel-baked painted metal, and the like). Beneath the housing 12 is a structural framework 30 that provides the strength and support needed for the apparatus 10 to perform all its functions. The structural framework 30 is a term referring generally to the structures of the apparatus 10 that provide rigidity and support to the appliance 10, but specifically does not include the cooktop 20 or any purely cosmetic structures (such as covers or side panels) or wiring harness covers and the like. Similarly, access panels 18 (e.g., an oven door) is also not part of the structural framework 30. The structural framework 30 is typically not visible in a completed apparatus 10 because the structural framework 30 is covered by the housing 12. Many types and shapes and sizes and numbers of components of a structural framework are possible, it being understood that in the manufacture of appliances, structural rigidity and function of the appliance are necessary, but minimizing costs and duration of manufacture and of assembly are desired. Some structural framework 30 comprises exoskeleton panels, rigid frames, truss sections, corner brackets, and beams and columns, any of which can be situated at strategic locations within the apparatus 10 to bear load. Similarly, structural framework 30 can include a framed box 31 at a top of the apparatus 10 that provides structural support for the cooktop 20.

The structural framework 30 shown in the Figures represents just one of many known arrangements for including strong, rigid members for a frame of an appliance 10. In the embodiment shown the framework 30 includes an upper front left member 32, upper front right member 34, and an upper rear member 36, and could obviously optionally also include an upper front member. These members provide locations for supporting the cooktop 20 on the structural framework 30. In a preferred embodiment the cooking apparatus 10 includes a grate hinge bracket 120. The grate hinge bracket 120 shown (see, e.g., FIGS. 3-4) includes upstanding first wall 122 and second wall 124 and upstanding third wall 126 and fourth wall 128 coupled by one or more bottom plates 121. In the embodiment shown in the Figures, the grate hinge bracket 120 includes one or more second grate hinge receiving portions 123 for receiving one or more hinges 125. The grate hinge bracket 120 can be fastened to the structural framework 30 in numerous locations, including locations within the cooktop perimeter 21, as well as locations outside of the cooktop perimeter 21, in each case not being fastened to the cooktop 20 itself.

Figure 7:
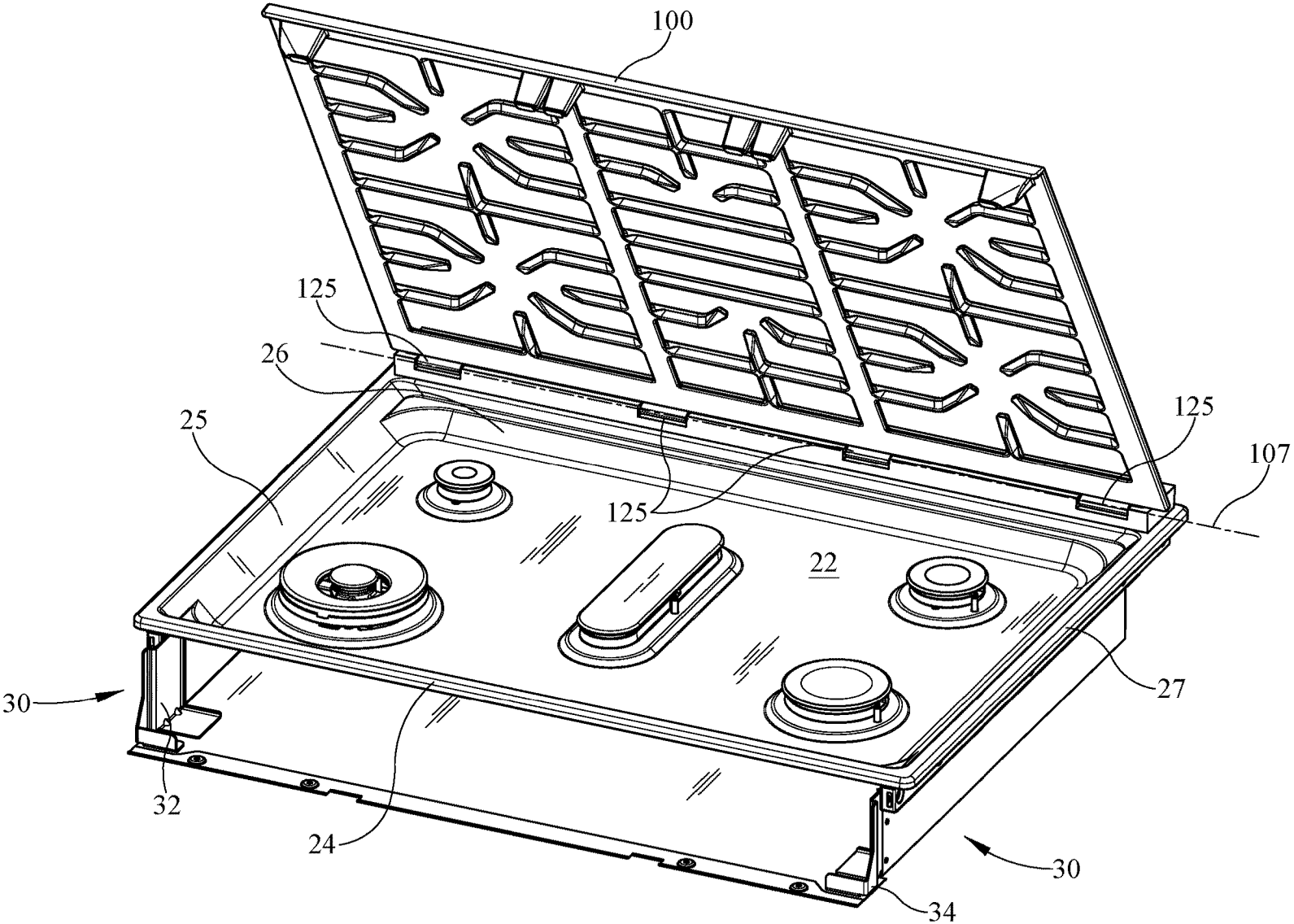
FIG. 7 is a top right front perspective view of one embodiment.
Figure 8:
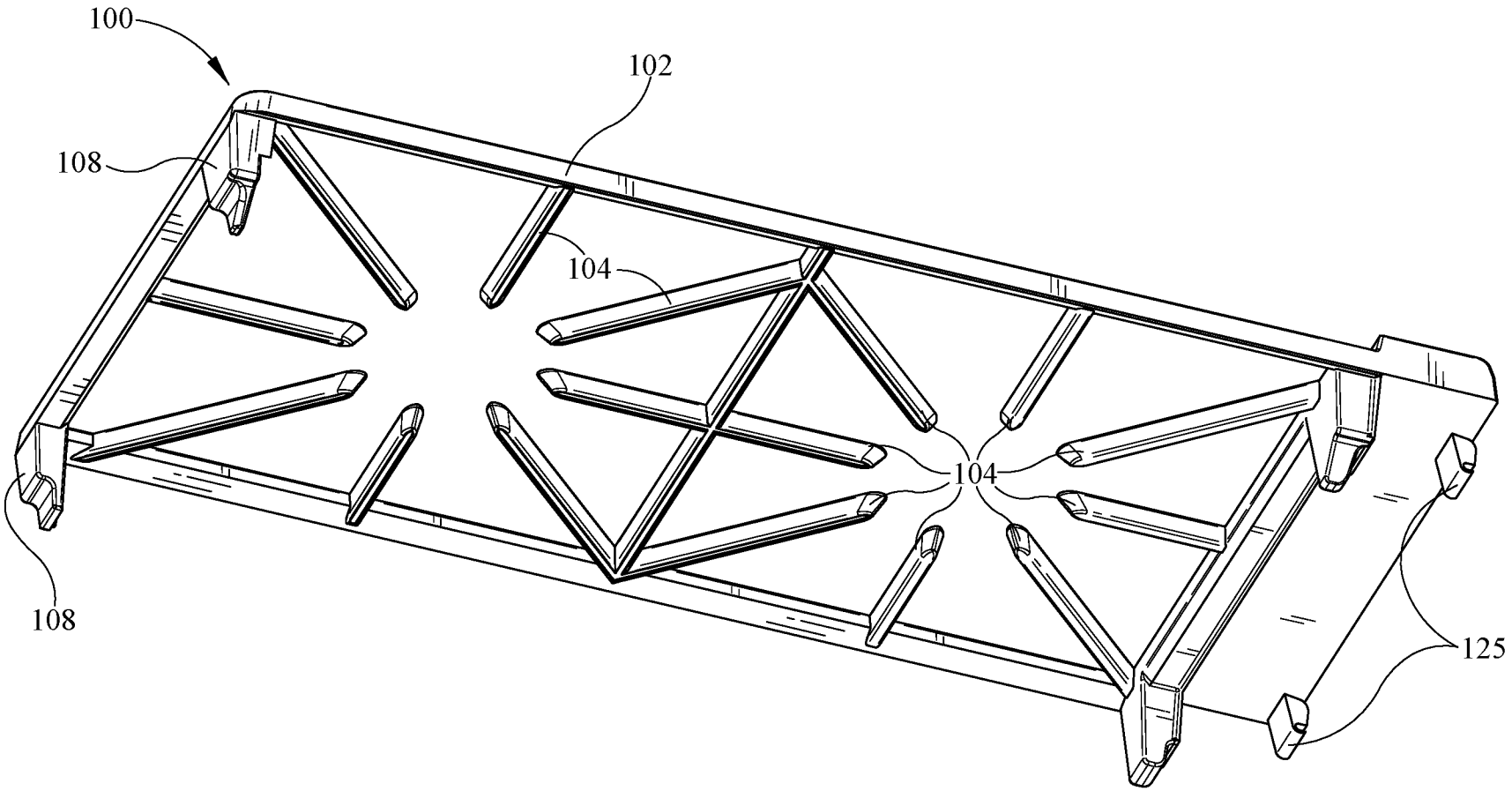
FIG. 8 is a bottom perspective of one embodiment of a cooking grate.
Figure 9:
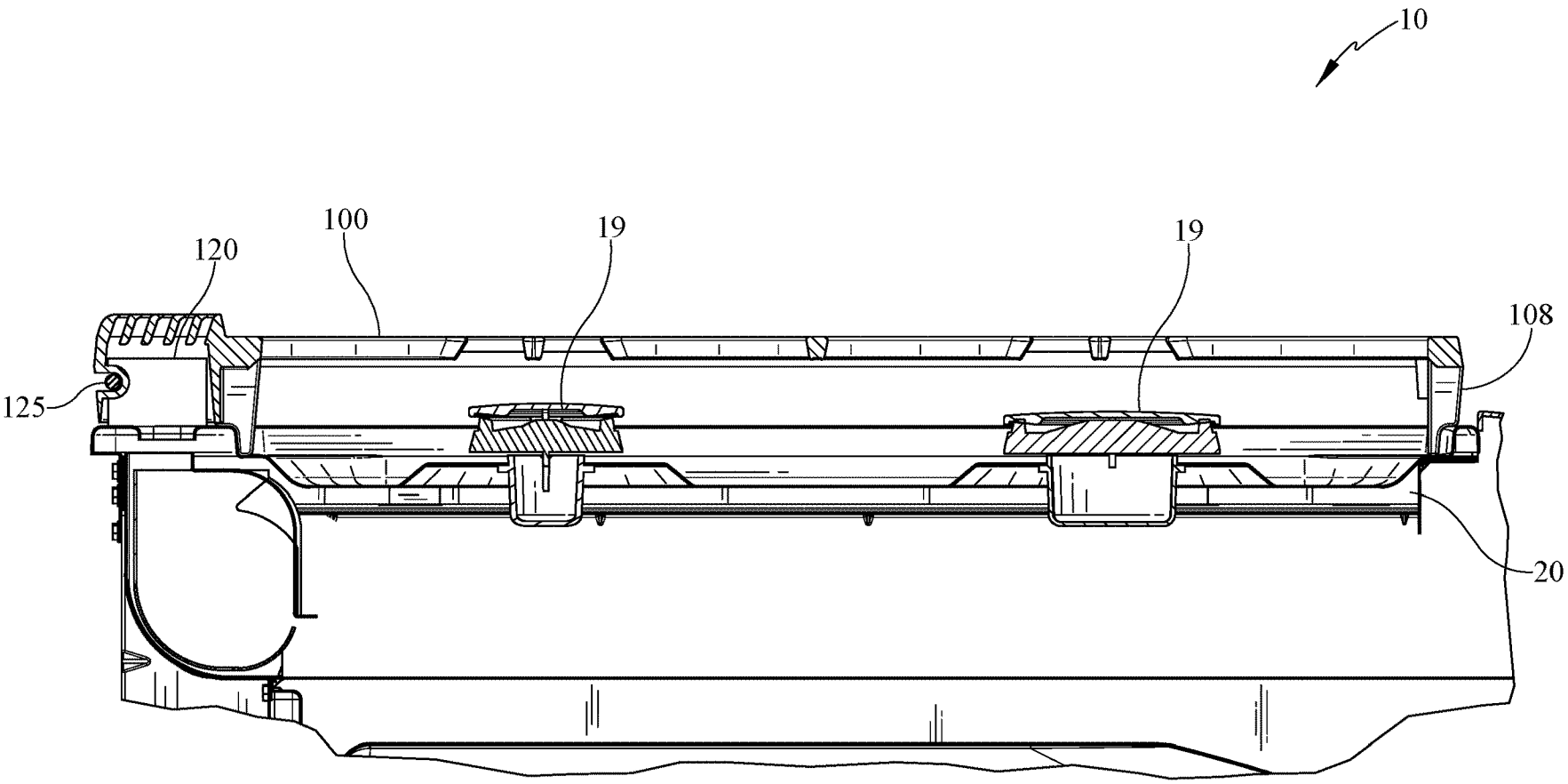
FIG. 9 is a side section view according to one embodiment.

Various embodiments can have differing numbers and arrangements of hinges 125, grate hinge brackets 120, and grates 100. For example, where a single grate 100 is used, the grate hinge bracket 120 can span the entire width of the grate 100 and can include one long hinge 125 or multiple smaller hinges 125. FIG. 7 shows a single hinged grate 100 wherein four hinges 125 are connected to respective first grate hinge receiving portions 106 of the grates 100 and to respective second grate hinge receiving portions 123 of the grate hinge bracket 120. The hinges 125 can be permanently fixed to either, or to both, of the grates 100 or the grate hinge brackets 120 (or alternatively to the structural framework 30), or they can be removably fixed to either, or to both. Preferably the grates 100 are removably hinged to the grate hinge brackets 120 (or alternatively to the structural framework 30) so that the grates 100 can be physically removed from the apparatus 10 as desired by a user (e.g., for cleaning the grates 100). An example embodiment of a hinge 125 that allows the grate 100 to be completely removed and separated from the apparatus 10 is a hinge 125 that is open along one end and therefore forms a "C" shape (see FIGS. 10A and 10B). Using such a hinge 125, a user can rotate the grate 100 about the hinge axis 107 to a point at which the hinge can slide out of the "C" shape, thus allowing the grate 100 to be removed completely from the apparatus 10.

As stated above, FIGS. 1-7, 10A, 10B, 11A, and 11B depict three grates 100, shown as left grate 100*a*, middle grate 100*b*, and right grate 100*c*. In the embodiments shown, two of the grates 100 include two hinges 125 each, while one of the grates 100 includes a single, longer hinge 125. As mentioned above, other embodiments are possible which include one or more griddles 110, wherein the griddles 110 are hinged to the structural framework 30 via griddle hinge portion 114.

In the preferred embodiments shown, the grate hinge bracket 120 is mounted to the upper rear member 36 through one or more hinge bracket openings 28 (see, e.g., FIG. 6) in the cooktop 20 with, for example, a plurality of screws or bolts connecting the bottom plate 121. In this manner, the grate hinge bracket 120 is connected directly to the structural framework 30 of the cooking apparatus 10, and not connected to the cooktop 20. This strong connection allows the grates 100 to be very large and heavy, if desired, and still be securely supported on the cooking apparatus 10, without requiring the cooktop 20 to be heavy.

In the embodiments shown in FIGS. 3-6, 8-9, 10A, and 10B, the grate hinge bracket 120 has its second grate hinge receiving portion 123 located on first wall 122. In this arrangement, the cooking grates 100 span across not only the cooktop 20, but also across the grate hinge bracket 120 itself. In this arrangement, the height of the first wall 122, second wall 124, third wall 126, and/or fourth wall 128, respectively, can be set to provide support for the grates 100 at the appropriate height above the burners 19 when the grates 100 are in the first position 150.

Alternatively, the grate hinge bracket 120 could have its second grate hinge receiving portion 123 located on second wall 124, as shown in FIG. 7. In this arrangement, the grates 100 can themselves be shorter than is the case when the second hinge receiving portion 123 is on the first wall 122. In such embodiments, the portion of the grates 100 that is located above the grate hinge bracket 120 can be, if desired, not hinged at all. This portion of the grates 100 can have similar arrangement of tines 104 as the hinged portion of grates 100, or can have different arrangements of tines 104.

Also, such alternative arrangement facilitates the use of an integrated vent and cooking grate, as is set forth in more detail in our co-pending patent application Ser. No. 15/198,815 entitled "Cooking Grate With Integrated Venting", the entire contents of which are incorporated by reference herein. In that incorporated application, details are provided for a cooking grate that integrates both the cooking surface and the venting surface into a common grate structure. The cooking grate 20 of that application can be the cooking grates 100 of the present disclosure, wherein the venting surface 20*b* of that disclosure can be, for example, a vent 116 at the rear portion of the cooking grates 100 shown in FIG. 1 herein, and also the cooking surface 20*a* of that disclosure can be, for example, the front portion of the cooking grates 100 shown in FIG. 1 herein.

As discussed above, FIGS. 1-7 and 10A depict grate hinge bracket 120 having upstanding walls 122, 124, 126, and 128 that protrude vertically above the top surface of the cooktop 20 and wherein the grate hinge bracket 120 is mounted to the structural framework 30 via hinge bracket openings 28 in the cooktop 20. Alternative embodiments of the grate hinge bracket 120 can be mounted to the structural framework 30 without attachment through any openings in the cooktop. In such case, rather than extending the entire depth of the apparatus 10 from the housing front 14 to the housing rear 16, the cooktop 20 could only extend from the housing front 14 to the second wall 124 of the grate hinge bracket 120. This eliminates the need for including hinge bracket openings 28 in the cooktop 20. It also allows the cooktop 20 to be smaller in size and less complicated to manufacture. The grates 100 can mount directly to the structural framework 30 without passing through the cooktop 20 at all. The cooktop 20 can mount directly to grate hinge bracket 120.

Figure 13:
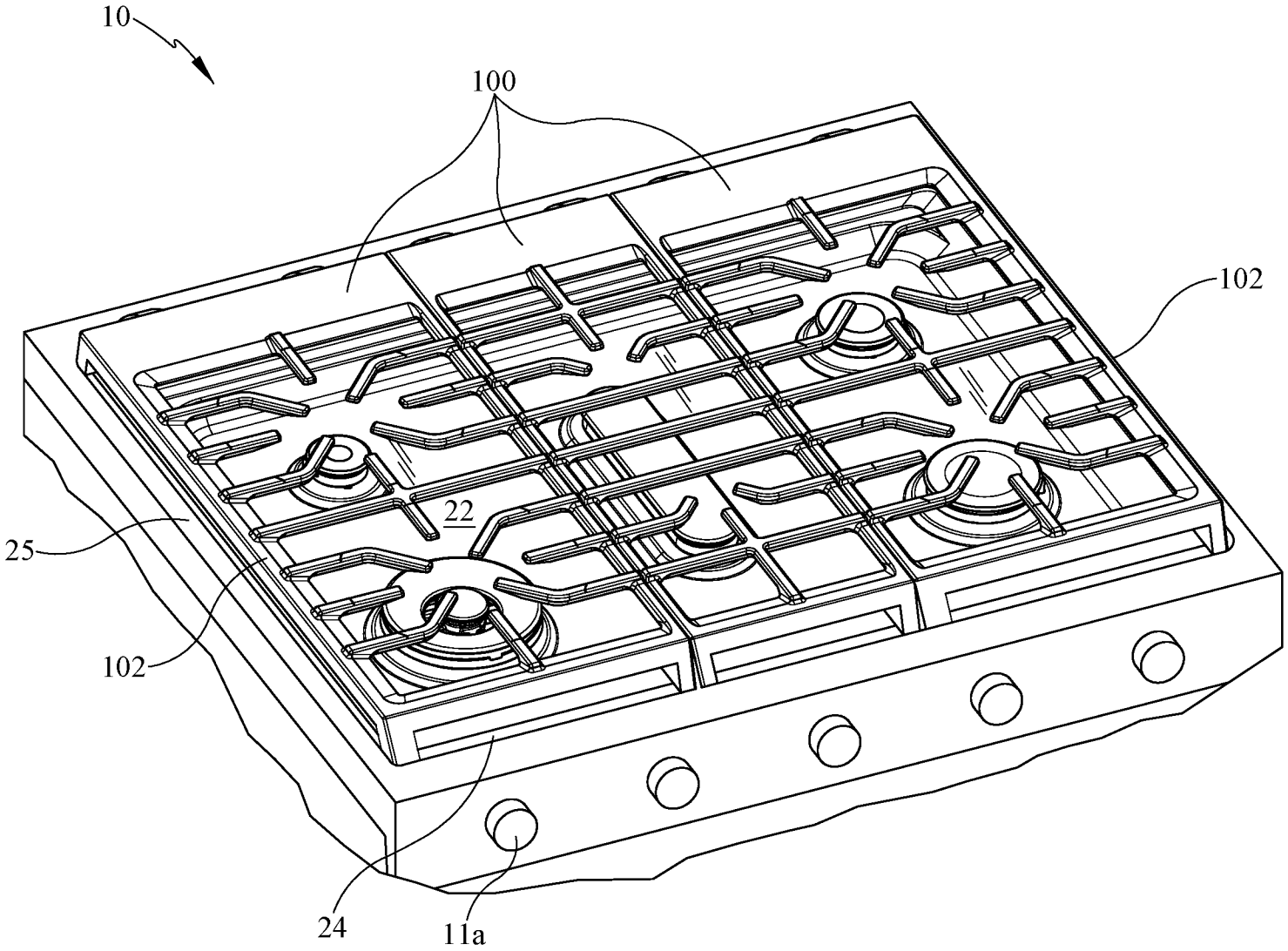
FIG. 13 is a top left front perspective of another embodiment.

In a further alternative embodiment, the grate hinge bracket 120 could be fully mounted beneath the surface of the cooktop 20. In such embodiment, there could be smaller openings in the cooktop 20 through which the hinges 125 pass. In such embodiment, as for example in FIG. 13, the outer frame 102 of the grates 100 could rest on the cooktop left side 25, cooktop right side 27, and cooktop front 24. In this case, the feet 108, if any, would be capable of being shorter than the feet 108 shown in embodiments shown in the FIGS. 1-8.

As discussed above, various embodiments are described having various numbers of grates 100, hinges 125, and various locations and arrangements of grate hinge bracket 120. The grate hinge brackets 120 can optionally be mounted to the structural framework 30 at other locations, not just the rear portion of the apparatus 10. For example, a grate hinge bracket 120 can be mounted to an upper front left member 32 (or to any portion of the structural framework 30 anywhere on a left side of apparatus 10) so that one or more grates 100 can be hinged from the left side of the apparatus 10. Similarly, a grate hinge bracket 120 can be mounted to an upper front right member 34 (or to any portion of the structural framework 30 anywhere on a right side of apparatus 10) so that one or more grates 100 can be hinged from the right side of the apparatus 10. Similarly, a grate hinge bracket 120 can be mounted to an upper front member, if present, so that one or more grates 100 can be hinged from the front side of the apparatus 10. And any combinations of rear, right, left, and/or front hinge arrangements are possible.

Similarly, as discussed above, any number of grates 100 is possible as well, including a single large grate 100 that spans substantially the entire cooktop 20, or multiple smaller grates 100 that, together, span the cooktop 20. Various arrangements for mounting and for hingedly connecting the grates 100 to the grate hinge brackets 120 exist.

Figure 4:
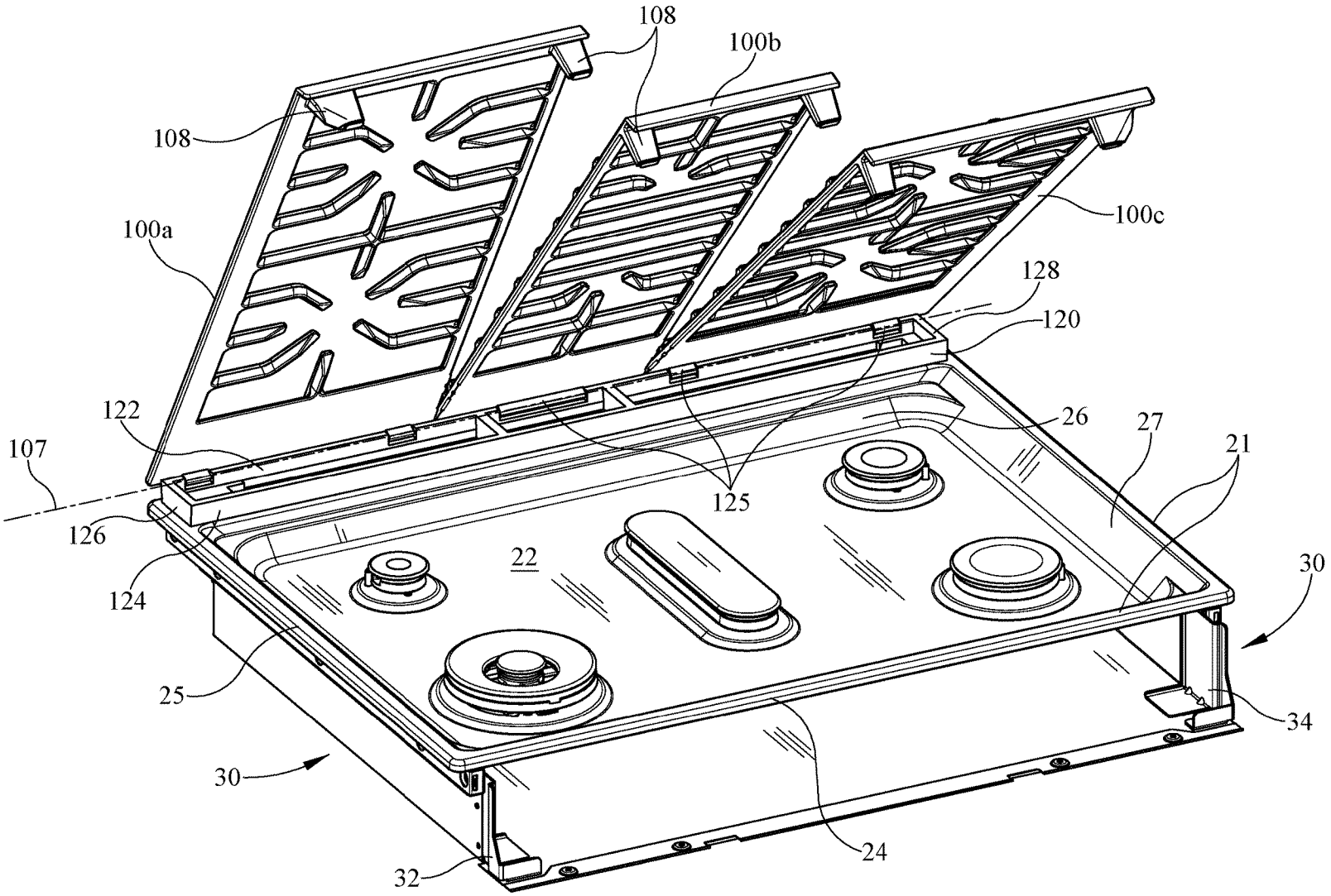
FIG. 4 is a top left front perspective view of one embodiment similar to that of FIG. 3 but showing each of three grates moveable independent of each other.
Figure 5:
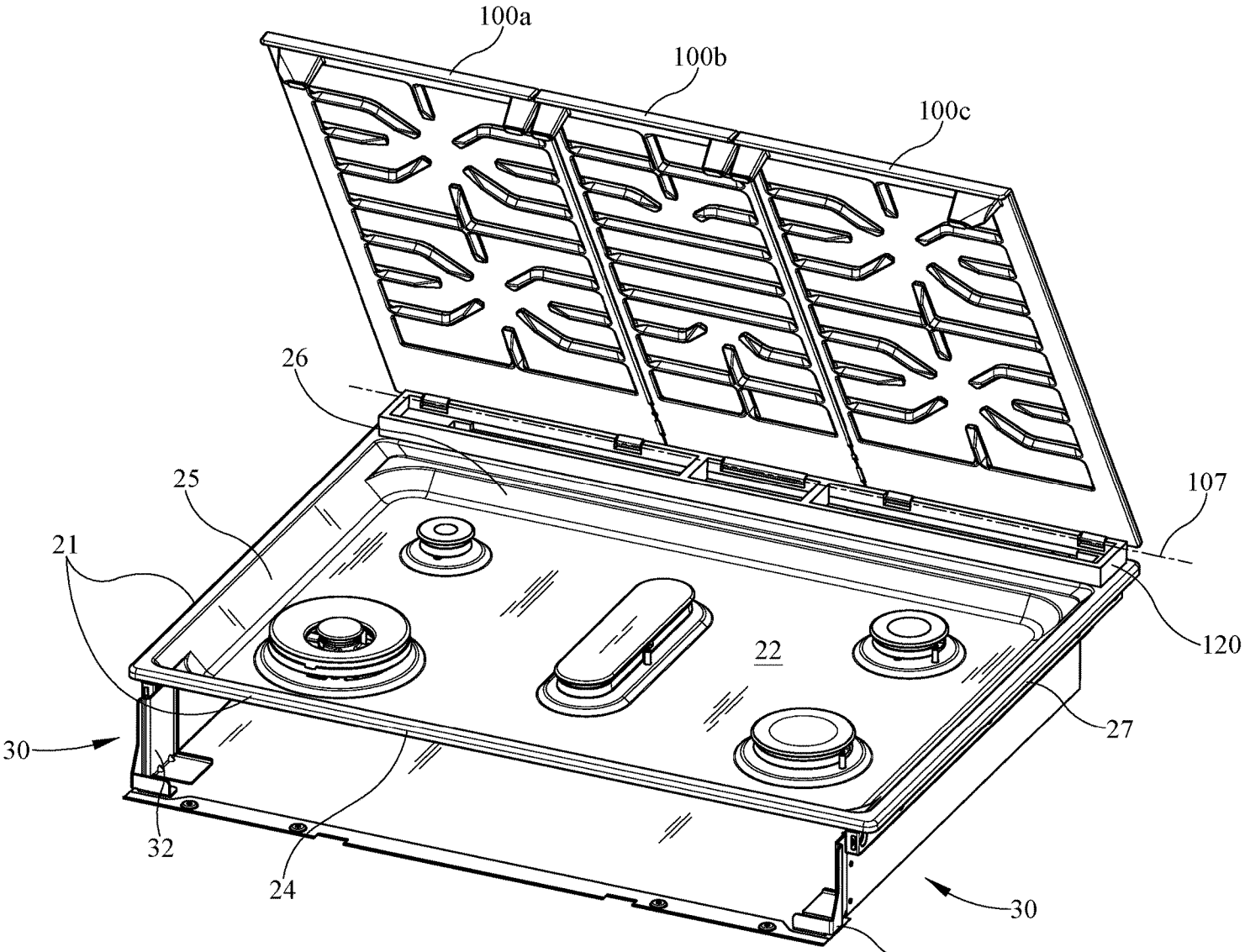
FIG. 5 is a top right front perspective view of one embodiment showing three cooking grates moveable as a combined unit.
Figure 6:
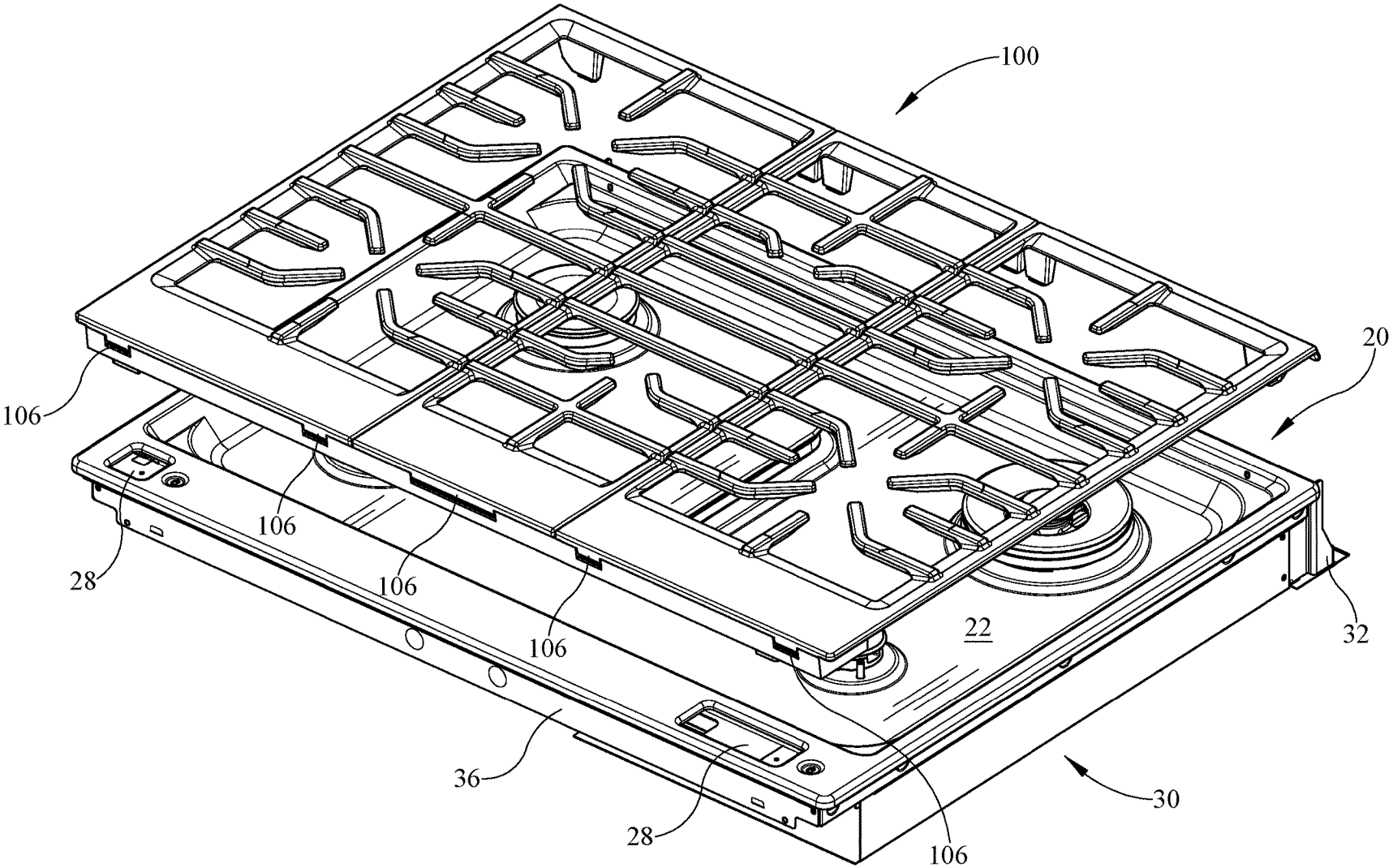
FIG. 6 is a top left rear perspective view of one embodiment.
Figure 14:
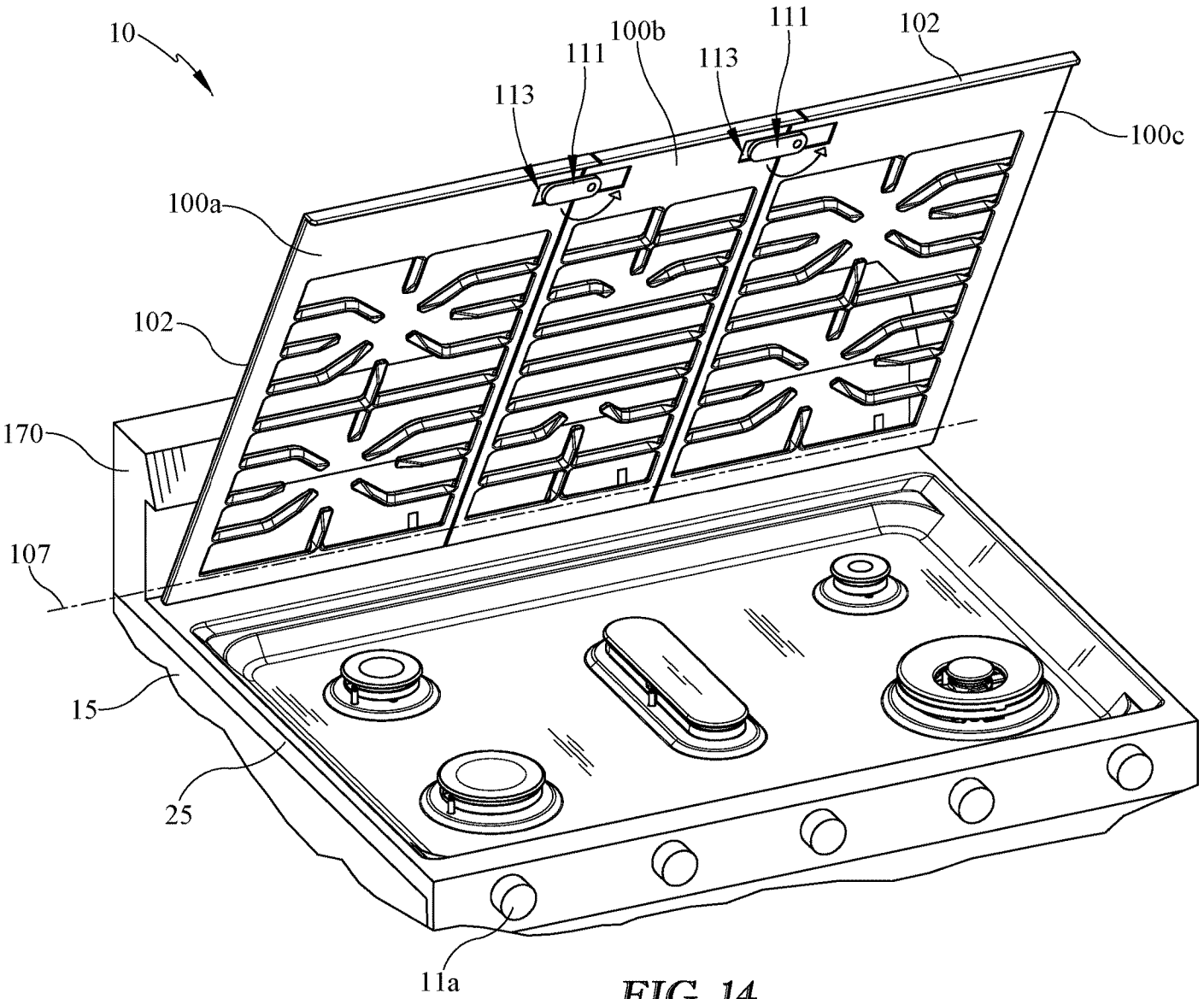
FIG. 14 is a top left front perspective of another embodiment.

Also, in embodiments with multiple grates 100, the grates 100 themselves can optionally couple with/decouple from adjacent grates 100 so that a user can selectively pivot one or more of the grates 100 during movement of any one or more of the grates 100 from the first position 150 through a range of positions to the second position 160, and vice versa. FIG. 4 shows one embodiment providing such selective pivoting. FIG. 14 shows an exemplary embodiment of coupling structure to facilitate such selective pivoting. As shown in FIG. 14, three grates are depicted: Left grate 100*a*, middle grate 100*b*, and right grate 100*c*. The right grate 100*c* comprises a finger 111 at a front left corner thereof and extending beyond the perimeter of the outer frame 102 and disposed in a direction substantially parallel to the hinge axis 107. The middle grate 100*b* has, at a front right corner thereof, a receptacle 113 that couplingly receives the finger 111 of the right grate 100*c*. The middle grate 100*b* also has, at its front left corner, a finger 111. The left grate 100*a* has, at its front right corner, a receptacle 113 for couplingly receiving the finger 111 of the middle grate 100*b*. With this arrangement, a user can pivot all three grates 100 from their respective first position 150 to the second position 160 by simply raising the right grate 100*c*. By doing so, the finger 111 of the right grate 100*c* engages the receptacle 113 of the middle grate 100*b*, and the finger 111 of the middle grate 100*b* engages a surface of the left grate 100*a* such that all three grates move as a unit. Optionally, if the user desires to move only the left grate 100*a*, the user can simply lift the outer frame 102 of the left grate 100*a* and it moves independently of the middle grate 100*b* because the receptacle 113 of the left grate 100*a* is not coupled to the finger of the middle grate 100*b*. In a similar fashion, the user can optionally move both the left grate 100*a* and the middle grate 100*b* independently from the right grate 100*c* by lifting the outer frame 102 of the middle grate 100*b*.

Many options for the coupling nature of the multiple grates 100 are possible within the scope of the invention. For example, the fingers 111 can be of many geometric shapes and sizes and can be disposed at multiple locations along the outer frame 102 of each grate 100. There can be multiple fingers 111 on each grate 100. The fingers 111 can be moveable (e.g., slideable along a direction, rotatable about a pivot, toggled between two positions, and the like) and/or retractable (e.g., a spring-loaded retractable finger 111 along an axis parallel to the hinge axis 107, a spring-loaded moveable finger 111 along a different axis, one-way biased finger 111 biased in a normally "engaged" position or biased in a normally "disengaged" position, a spring-loaded ball detent providing a spring locking force in one or more positions of the finger 111, and the like), such that a user can decide whether and when to deploy each finger 111 from an engaged position (that is, engaged with an adjacent grate) or a disengaged position, and/or vice versa.

Similarly, many options for the receptacle 113 exist within the scope of the invention. For example, each receptacle 113 can be, as shown in FIG. 4 with each finger 111 being fixed (that is, non-moveable and non-rotatable), a partially open geometric shape that makes one-way contact with the finger 111. That is, only when grates 100*c* and/or 100*b* are moved from the first position 150 toward the second position 160 do fingers 111 contact a surface of the receptacles. Also possible, even for non-moveable fingers 111, are receptacles that themselves move. For example, the receptacles 113 could be moveable (e.g., along an axis thereof—that is, sliding along their axis) from a first position wherein fingers 111 cannot make contact with the receptacles 113, to a second position wherein fingers 111 can make contact with the receptacles 113. Similarly, the receptacles 113 could be moveable (e.g., about an axis thereof—that is, rotating around their own axis) from a first position wherein fingers 111 cannot make contact with the receptacles 113, to a second position wherein fingers 111 can make contact with the receptacles 113.

Many alternatives exist for receptacles 113 that couple with moveable fingers 111. For example, for moveable and/or retractable fingers 111, the receptacles 113 can be as simple as a geometric surface that engages the finger 111 when the finger 111 is in an engaged position and that does not engage the finger 111 when the finger 111 is in a disengaged position. In the embodiments described herein, the user has the ability to move one or more of the grates 100 simultaneously, as well as moving more than one, or all, of the grates 100 as a single unit.

Figure 11B:
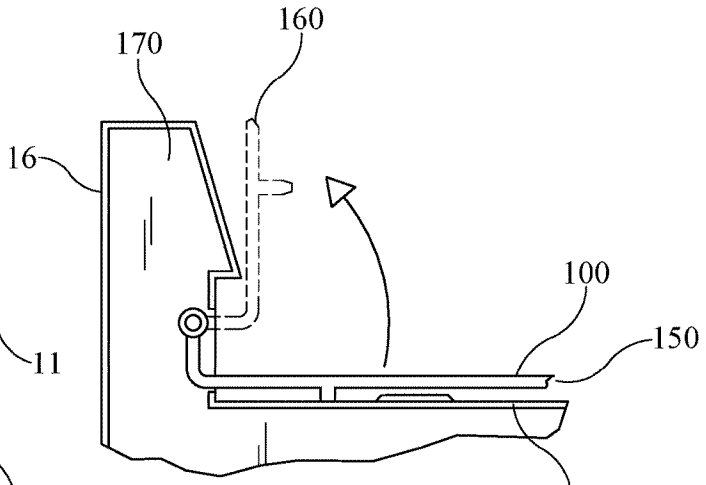
FIG. 11B is a side schematic of a hinge of one embodiment.
Figure 11A:
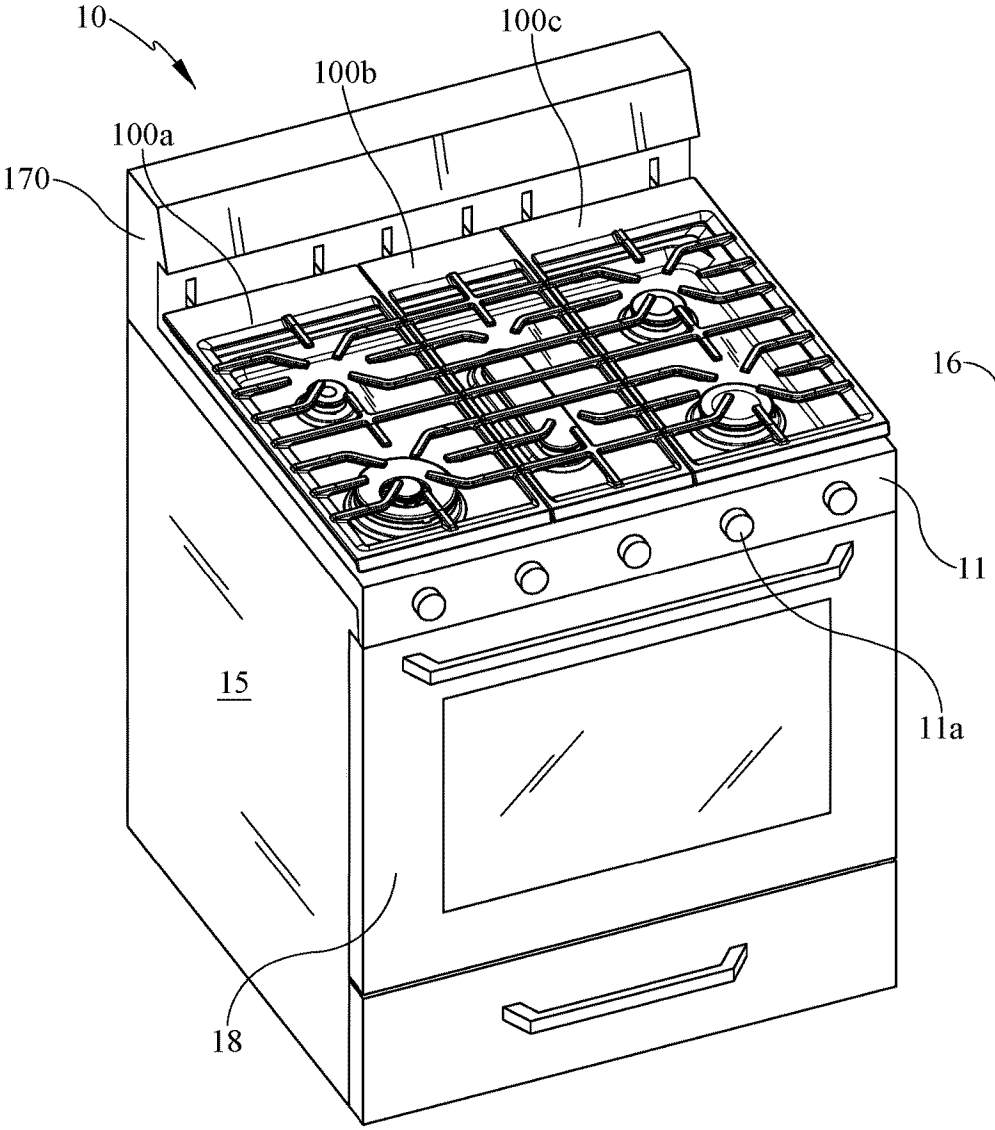
FIG. 11A is a perspective view of a free-standing range having a hinged cooking grate according to one embodiment.
Figure 12:
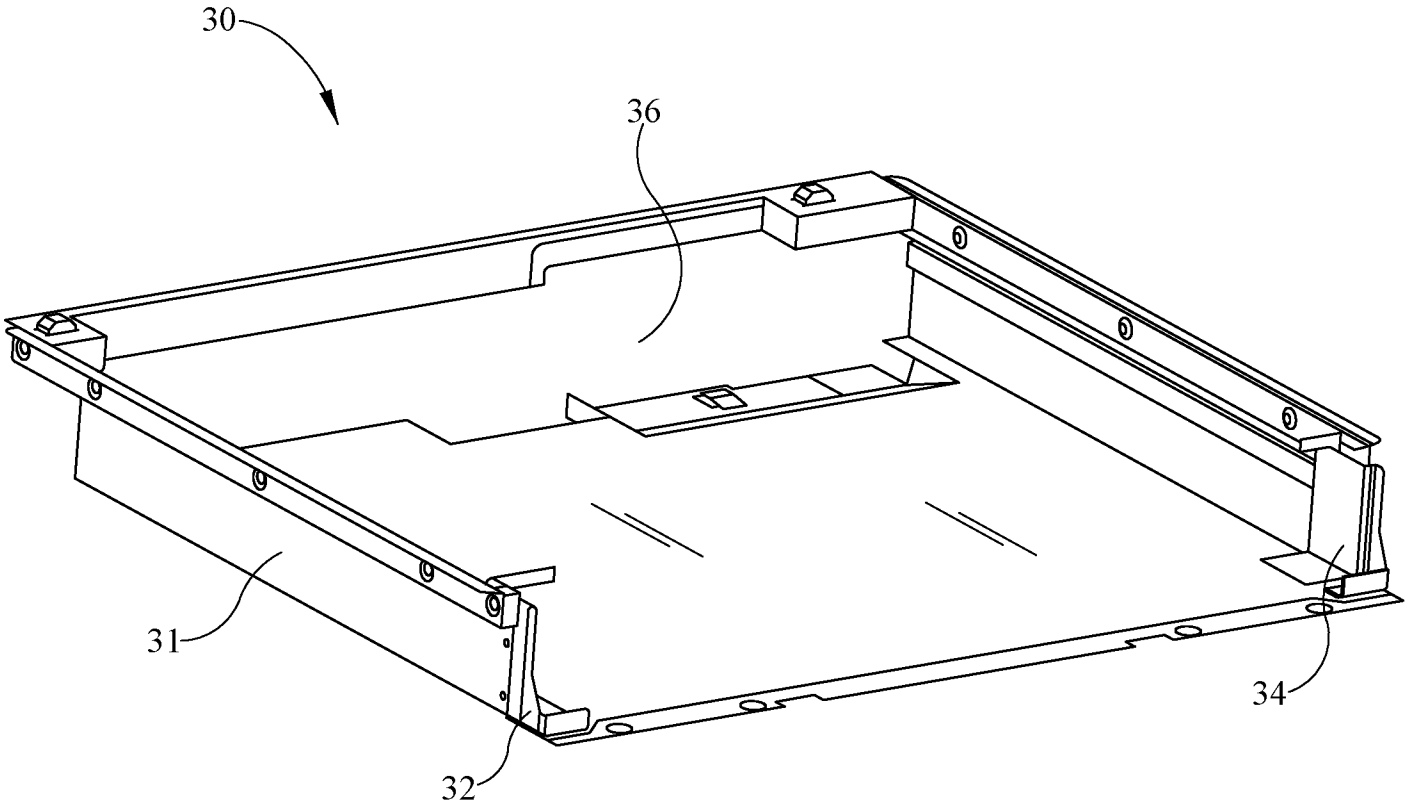
FIG. 12 is a top left front perspective view of structural support according to one embodiment for cooking grates.

The embodiments shown in FIGS. 1-10A, as discussed, depict a slide-in range. But the structures and methods described herein apply equally well to a free-standing range. FIG. 11A depicts an exemplary free-standing range cooking appliance 10. In such embodiments, the grates 100 can be mounted to the structural framework 30 with similar grate hinge brackets 120. The grate hinge brackets 120 can be mounted to the horizontally disposed section of the structural framework 30 as shown in FIGS. 1-7, but can alternatively be mounted to the vertically disposed upswept portion 170.

Figure 15B:
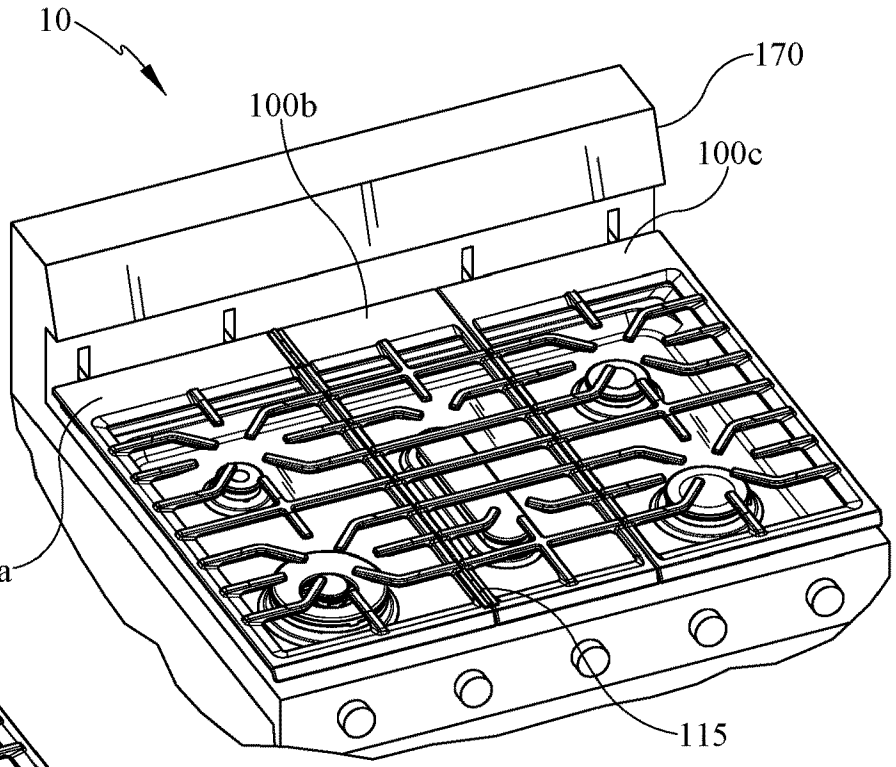
FIG. 15B is a top left front perspective of another embodiment.
Figure 15A:
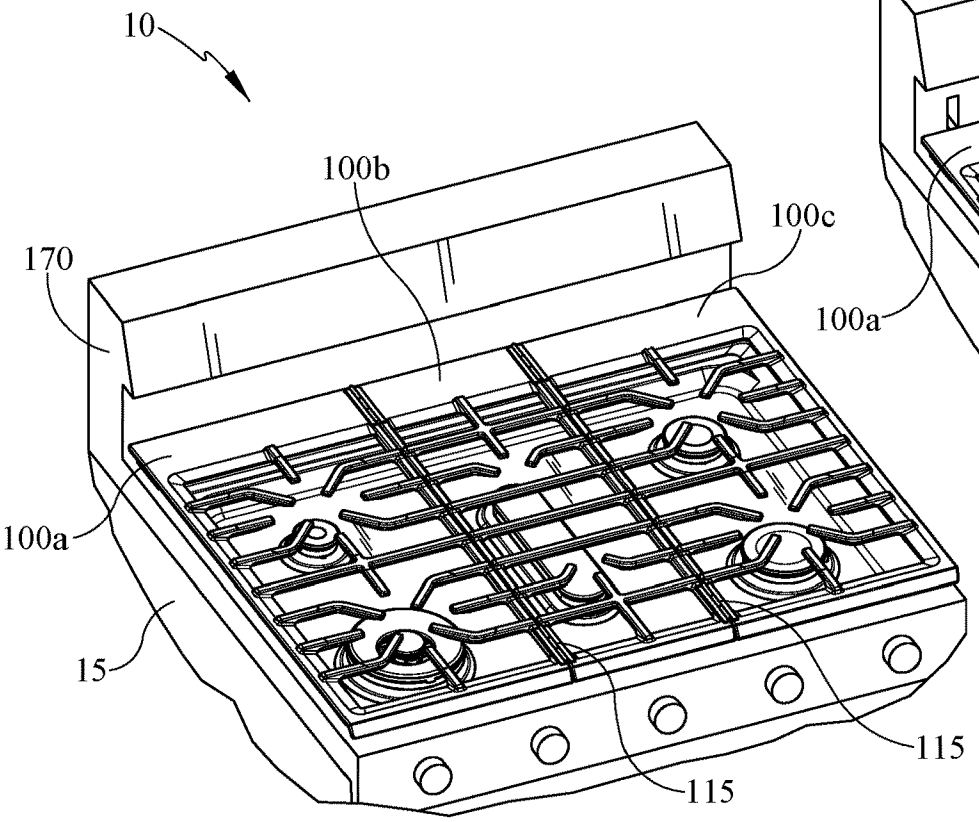
FIG. 15A is a top left front perspective of another embodiment.

Additional options for the hinged grates 100 are also possible. For example, in one alternative embodiment, one or more grates 100 may be connected to another grate 100, such as by additional hinges 115. This can enable one or more of the grates 100 to not be connected to the structural framework at all. Stated otherwise, fewer than all the grates 100 may be connected to the structural framework 30, while some of the grates 100 are only connected to other grates 100. FIG. 15A depicts an embodiment of grates 100 wherein the left grate 100*a* is hinged via hinge 115 to the middle grate 100*b*, and the middle grate 100*b* is also hinged to the right grate 100*c* via hinge 115. As depicted in this embodiment, none of the grates 100 are hinged to the structural framework 30. FIG. 15B depicts an embodiment wherein middle grate 100*b* is hinged to left grate 100*a* via hinge 115, but right grate 100*c* is not hinged to middle grate 100*b*. In this embodiment, each of left grate 100*a* and right grate 100*c* is hinged to the structural framework 30 as described above, but middle grate 100*b* is not coupled to the structural framework 30. Stated otherwise, the only hinged connection present on middle grate 100*b* in this embodiment is its connection to the left grate 100*a* via hinge 115. This allows a user to rotate middle grate 100*b* into position overlapping the top of left grate 100*a*, and then pivot the combined left grate 100*a*/middle grate 100*b* as a unit from the first position 150 through a range of positions to the second position 160.

Figure 16:
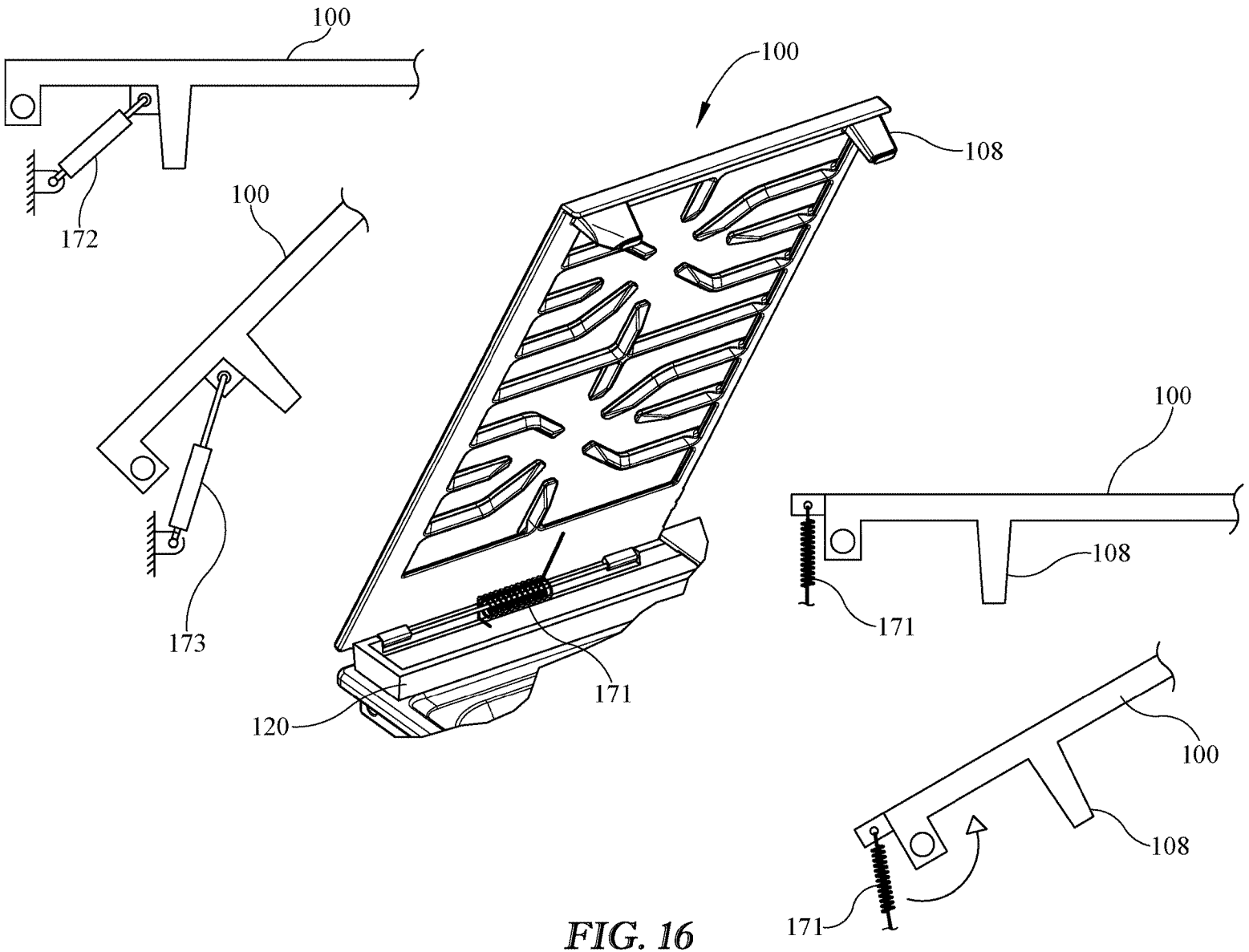
FIG. 16 is a figure showing various embodiments of a soft close mechanism.

Additional embodiments are also possible that facilitate raising and lowering the grates 100 to and from their respective first position 150 and second position 160. For example, as shown in FIG. 16, one of various types of known "soft-close" structure could be added to one or more grates 100. These can take many forms known in the art, and include, but are not limited to, spring-assisted open/close hinges 171; hydraulic closing tube members 172; gas-operated closing tube members 173; and the like. Such apparatus can not only reduce the likelihood of having the grates 100 slam or fall too quickly onto the cooktop bottom 22, but can also assist a user in lifting the one or more grates 100.

Figure 17:
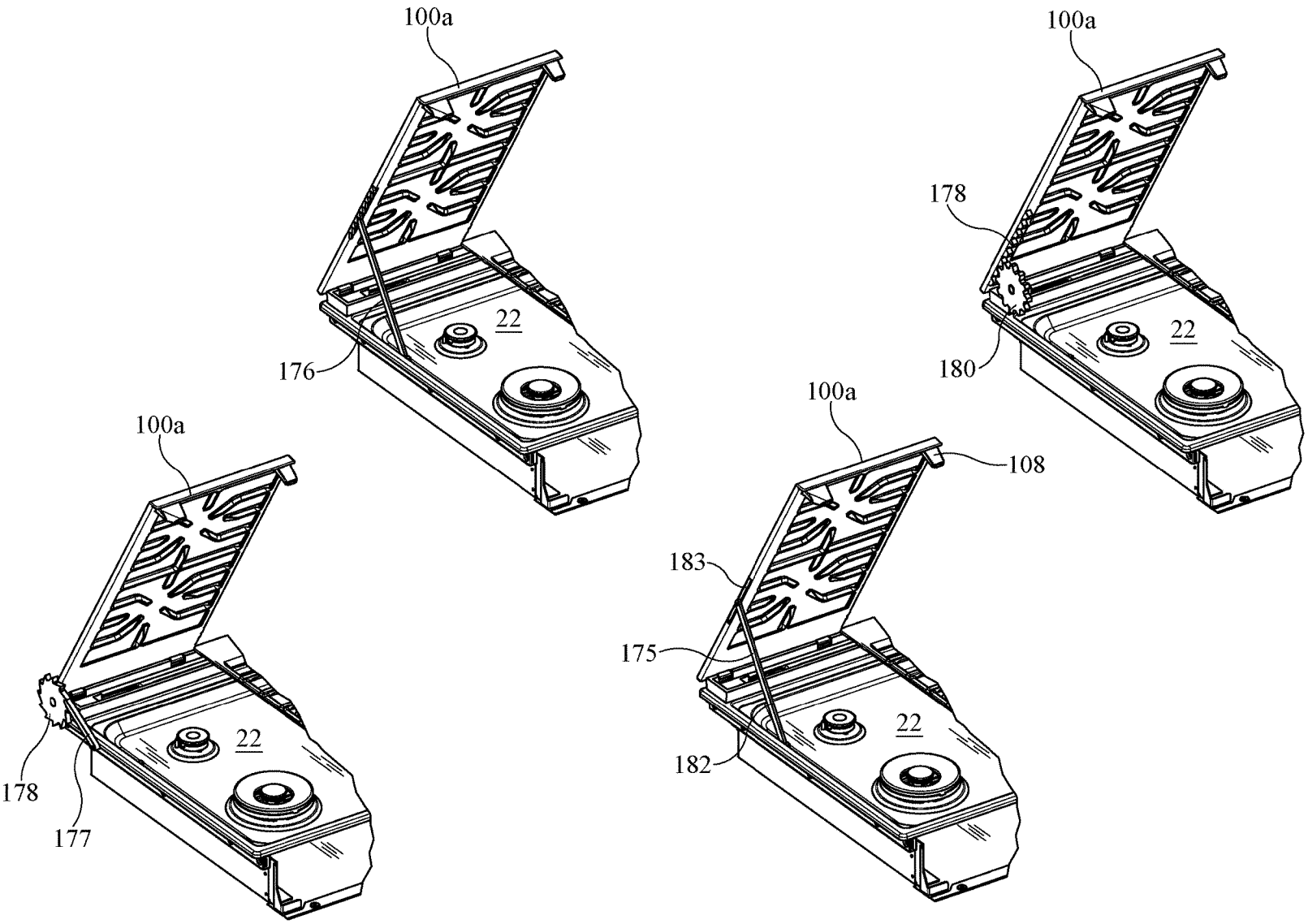
FIG. 17 is a figure showing various embodiments of a holding mechanism.

Similarly, as shown in FIG. 17, various embodiments can include features or mechanisms for holding one or more grates 100 into one or more positions between, and including, the first position 150 and/or the second position 160. For example, a single or multi-position kickstand 175 can be attached to one or more grates 100. The kickstand 175 can, for example, be deployed into one or more holding positions whenever the grate 100 is not resting on the cooktop 20. Similarly, a ratchet 176 can be used which has multiple stop positions associated with various heights or orientations of the grates 100. Similarly, a pawl 177 and gear 178 combination can be used. A rack 179 and pinion 180 can be used. Other forms of gears (such as screw gears 181) can also be used. Also, an arm 182 and slot 183 arrangement can be used, wherein multiple slots 183 provide various settings for the relative position or height of the grates 100. Also possible is the use of a spring-loaded ratchet 184 that is spring assisted in its opening or closing direction, and has associated with an arm of the ratchet 184 one or more catch positions. These and other embodiments for holding or positioning one or more grates 100 at various orientations or heights are possible.

Although the integrated cooking grate 20 is shown in detail in the drawings, it is merely representative of one embodiment, and it is to be understood that there are a variety of shapes, sizes, orientations, constructions, and quantities which may be used and still be within the scope of the teachings herein.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and many modifications and variations are possible in light of the above teaching.

What is claimed is:

1. A cooking appliance comprising:

a structural framework;

a cooktop supported by said structural framework having a cooktop bottom and a cooktop perimeter further comprising a cooktop front, a cooktop rear, a cooktop left side, and a cooktop right side;

a grate hinge bracket positioned at a first location external to said cooktop perimeter and adjacent to one of said cooktop front, cooktop rear, cooktop left side, or cooktop right side, wherein said grate hinge bracket is directly coupled to said structural framework at said first location, wherein said first location does not go through said cooktop bottom.

2. In a cooking appliance having a structural framework and a cooktop supported by the structural framework, wherein the cooktop has a first burner opening therethrough and a cooktop perimeter defining an outermost periphery of said cooktop, the improvement comprising:

at least one hinge bracket opening in said cooktop disposed internal to said cooktop perimeter;

a cooking grate forming a cooking surface for supporting a cooking vessel disposed above said first burner opening; and a grate hinge bracket mounted directly to said structural framework for hinged connection to said cooking grate through said at least one hinge bracket opening in said cooktop to allow said cooking grate to pivot through a range of positions from a first position to a second positions, wherein in said first position said cooking grate is disposed horizontally over said first gas burner and in said second position said cooking grate is disposed at an angle with respect to the cooktop.

3. A cooking appliance comprising:

a structural framework;

a cooktop supported by said structural framework having a first burner opening therethrough and having a cooktop perimeter having a cooktop rear edge, a cooktop left edge, a cooktop right edge, and a cooktop front edge;

a first gas burner extending through said first burner opening in said cooktop, said first gas burner being connected to a gas source;

a cooking grate forming a cooking surface for supporting a cooking vessel disposed above said first gas burner for cooking food; and a grate hinge bracket mounted directly to said structural framework for hinged connection to said cooking grate to allow said cooking grate to pivot through a range of positions from a first position to a second position, wherein in said first position said cooking grate is disposed horizontally over said first gas burner and in said second position said cooking grate is disposed at an angle with respect to the cooktop.

4. The cooking appliance of claim 1 wherein said grate hinge bracket is located adjacent a housing rear of said appliance and behind said cooktop rear edge.

5. The cooking appliance of claim 1 wherein said grate hinge bracket is located adjacent a housing left side of said appliance and closer to said housing left side of said appliance than is said cooktop left edge.

6. The cooking appliance of claim 1 wherein said grate hinge bracket is located adjacent a housing right side of said appliance and closer to said housing right side of said appliance than is said cooktop right edge.

7. The cooking appliance of claim 1 wherein said grate hinge bracket is located adjacent a housing front side of said appliance and closer to said housing front side of said appliance that is said cooktop front edge.

8. The cooking appliance of claim 1 wherein said grate hinge bracket is mounted to said structural framework through a grate hinge bracket opening in said cooktop that is internal to said cooktop perimeter.

9. The cooking appliance of claim 8 wherein said grate hinge bracket opening in said cooktop is located adjacent a housing rear of said appliance.

10. The cooking appliance of claim 8 wherein said grate hinge bracket opening in said cooktop is located adjacent a housing left side of said appliance.

11. The cooking appliance of claim 8 wherein said grate hinge bracket opening in said cooktop is located adjacent a housing right side of said appliance.

12. The cooking appliance of claim 8 wherein said grate hinge bracket opening in said cooktop is located adjacent a housing front side of said appliance.

13. The cooking appliance of claim 1 further comprising at least two cooking grates.

14. The cooking appliance of claim 13 wherein said at least two cooking grates are moveable together as a combined unit of cooking grates.

15. The cooking appliance of claim 13 wherein said at least two cooking grates are moveable independently.

16. The cooking appliance of claim 13 wherein said at least two cooking grates are hingedly connected to each other.

17. The cooking appliance of claim 1 wherein said cooking grate further comprises a soft-close structure.

18. The cooking appliance of claim 1 wherein said cooking grate further comprises a holding mechanism.

19. The cooking appliance of claim 1 wherein said cooking grate further comprises a vent.

20. The cooking appliance of claim 1 wherein said cooking grate further comprises a griddle.

* * * * *